US005328219A

United States Patent [19]

Konchan et al.

[11] Patent Number: 5,328,219

[45] Date of Patent: Jul. 12, 1994

[54] VEHICLE CLOSURE LATCH

[75] Inventors: Jeffrey L. Konchan, Shelby Twp.; Alfred L. Portelli, Waterford; Rita M. Paulik, Sterling Heights, all of Mich.

[73] Assignee: General Motors Corporation, Detroit, Mich.

[21] Appl. No.: 996,816

[22] Filed: Dec. 24, 1992

[51] Int. Cl.[5] ..... E05C 3/16

[52] U.S. Cl. ..... 292/216; 292/1; 292/DIG. 38

[58] Field of Search ..... 292/1, 216, 280, DIG. 38, 292/337

[56] References Cited

U.S. PATENT DOCUMENTS 3,876,238 4/1975 Watermann ..... 292/216
4,097,078 6/1978 Tack et al. ..... 292/216
4,575,138 3/1986 Nakamura et al. ..... 292/216
4,756,563 7/1988 Garwood et al. ..... 292/216
4,898,414 2/1990 Yamada ..... 292/216 X

*Primary Examiner*—Rodney M. Lindsey
*Attorney, Agent, or Firm*—Charles E. Leahy

[57] ABSTRACT

A ratchet type vehicle closure latch is secured to a vehicle door by a pair of bolts. One is located in proximity to engaged teeth of a rotatable ratchet and pawl and the other is located in proximity to engaged portions of the ratchet and a striker. The closure latch has a plastic housing that includes a thin integral plastic sleeve that breaks away in service to provide a sleeve bearing that eliminates metal-on-metal contact between the rotatable ratchet and a ratchet stud. The ratchet stud and a pawl stud hold several parts of the door latch together. The door latch has several non-metallic parts and an insert molded ratchet for minimizing the metal-on-metal engagement, operational noise and lubrication requirements. Some parts are non-handed and other parts are identical to reduce manufacturing costs.

27 Claims, 5 Drawing Sheets

VEHICLE CLOSURE LATCH

BACKGROUND OF THE INVENTION

This invention relates to a vehicle closure latch and more particularly to a ratchet type vehicle closure latch.

Ratchet type vehicle closure latches are well known and have been used for many years. See for example, U.S. Pat. No. 4,756,563 granted to Garwood et al Jul. 12, 1988 that is assigned to the assignee of this invention.

SUMMARY OF THE INVENTION

The object of this invention is to provide a ratchet type vehicle closure latch that is substantially smaller and more compact than the Garwood vehicle door latch and others that are presently available while at least retaining but preferably enhancing other desirable features of the vehicle closure latch.

A feature of the vehicle closure latch of this invention is that the vehicle closure latch is substantially reduced in size while at the same time it has high strength and high energy absorption characteristics. These characteristics result in part from the arrangement and positioning of studs and mounting bolts and in part from a metal door latch frame that includes retaining tabs and that has an increased minimum thickness between the ratchet stud hole and a fishmouth slot that is shaped to receive a striker of rectangular cross section and maintain low operating effort.

Another feature of the vehicle closure latch of this invention is that the vehicle closure latch requires very little if any lubrication. This is accomplished by extensive use of plastic parts and an insert molded closure latch ratchet that eliminates virtually all metal-to-metal contact except for the engagement of the closure latch ratchet and the closure latch pawl in the primary latch position and even in this instance the closure latch pawl may be constructed as an oil impregnated powder metal part that is lubricated for life.

This requirement for little or no lubrication is also due in part to a unique plastic bearing sleeve that is an integral part of the plastic housing to facilitate assembly procedures and then breaks away in service to provide a sleeve bearing between the metal substrate of the closure latch ratchet and the metal ratchet stud so as to eliminate metal-to-metal contact between these two parts.

Another feature of the vehicle closure latch of this invention is that the vehicle closure latch is quiet in operation. This is due in part to the extensive use of plastic parts as stated above, the break-away plastic bearing sleeve described above and a unique closure latch ratchet that comprises a metal substrate that is insert molded in plastic to provide sound deadening cushions to quiet operation. The pawl also contributes to quiet operation when constructed of powder metal.

Still another feature of the vehicle closure latch of the invention is that the vehicle closure latch is economical to manufacture. This is due in part to the elimination of clips and springs, the use of a common part for the inside locking lever and the inside operating lever, the use of non-handed parts such as the bumper striker that can be used in right hand and left hand assemblies and the use of springs that are molded as an integral part of the intermittent lever and the locking lever.

Still yet another feature of the vehicle closure latch of the invention is that the vehicle closure latch has a small foot print due in part to the requirement for only two mounting bolts which is made possible by the use of two dual function studs that not only provide pivots for the ratchet and pawl but also hold several latch parts together. This requirement for only two mounting bolts also reduces assembly costs for the vehicle door manufacturer and improves the aesthetics of the installation.

Still yet another feature of the vehicle closure latch of the invention is that the closure latch is small enough to use as a hood latch or as a trunk latch.

These and other features of the closure latch of this invention will be readily apparent to those skilled in the art as the nature of the invention is better understood from the accompanying drawings and detailed description.

DESCRIPTION OF THE PREFERRED EMBODIMENT

Figure 1:
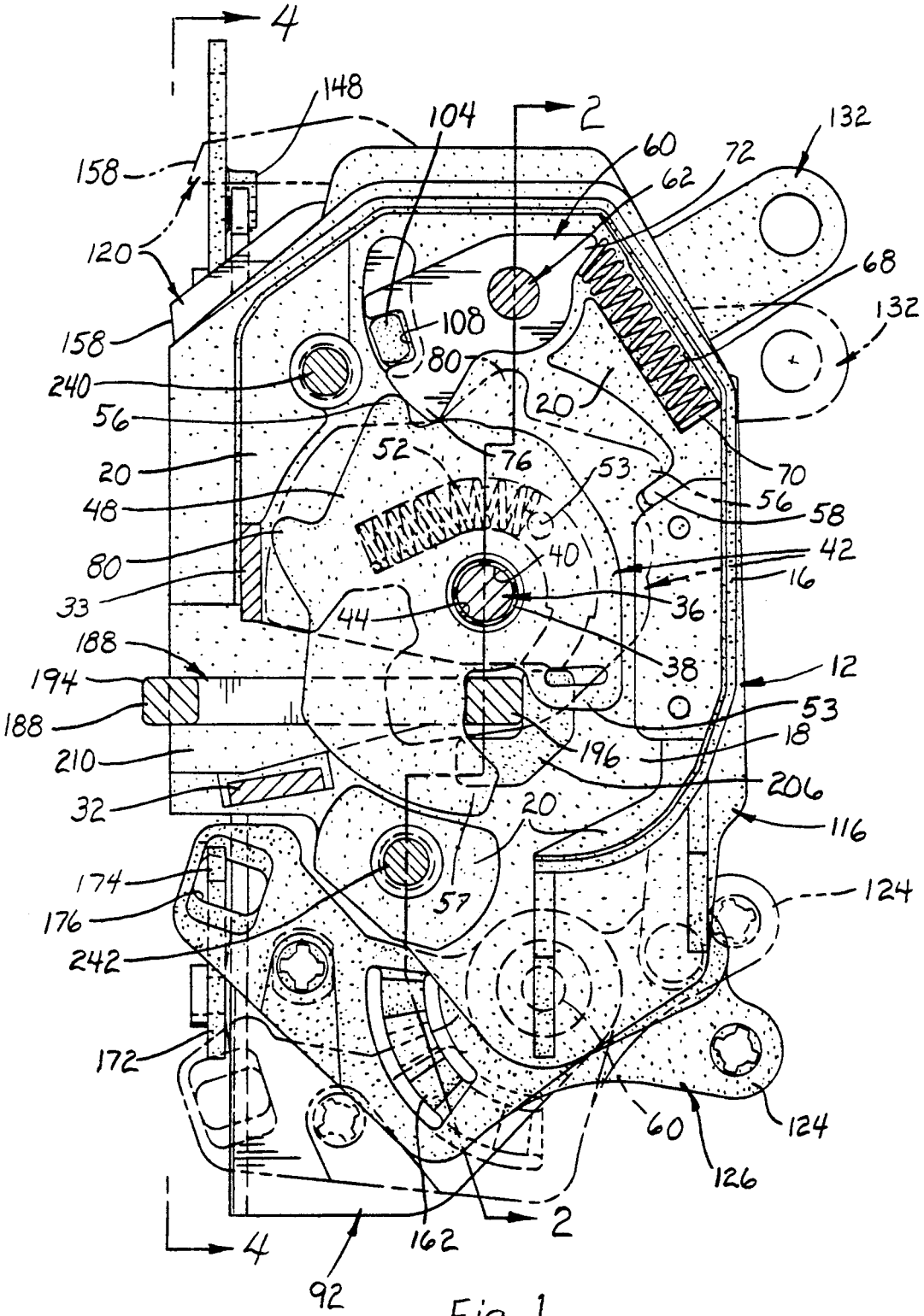
FIG. 1 is a partially broken away front view showing a vehicle closure latch of the invention in a latched and unlocked condition in solid lines. Various parts are also shown in phantom in unlatching or locked positions.
Figure 2:
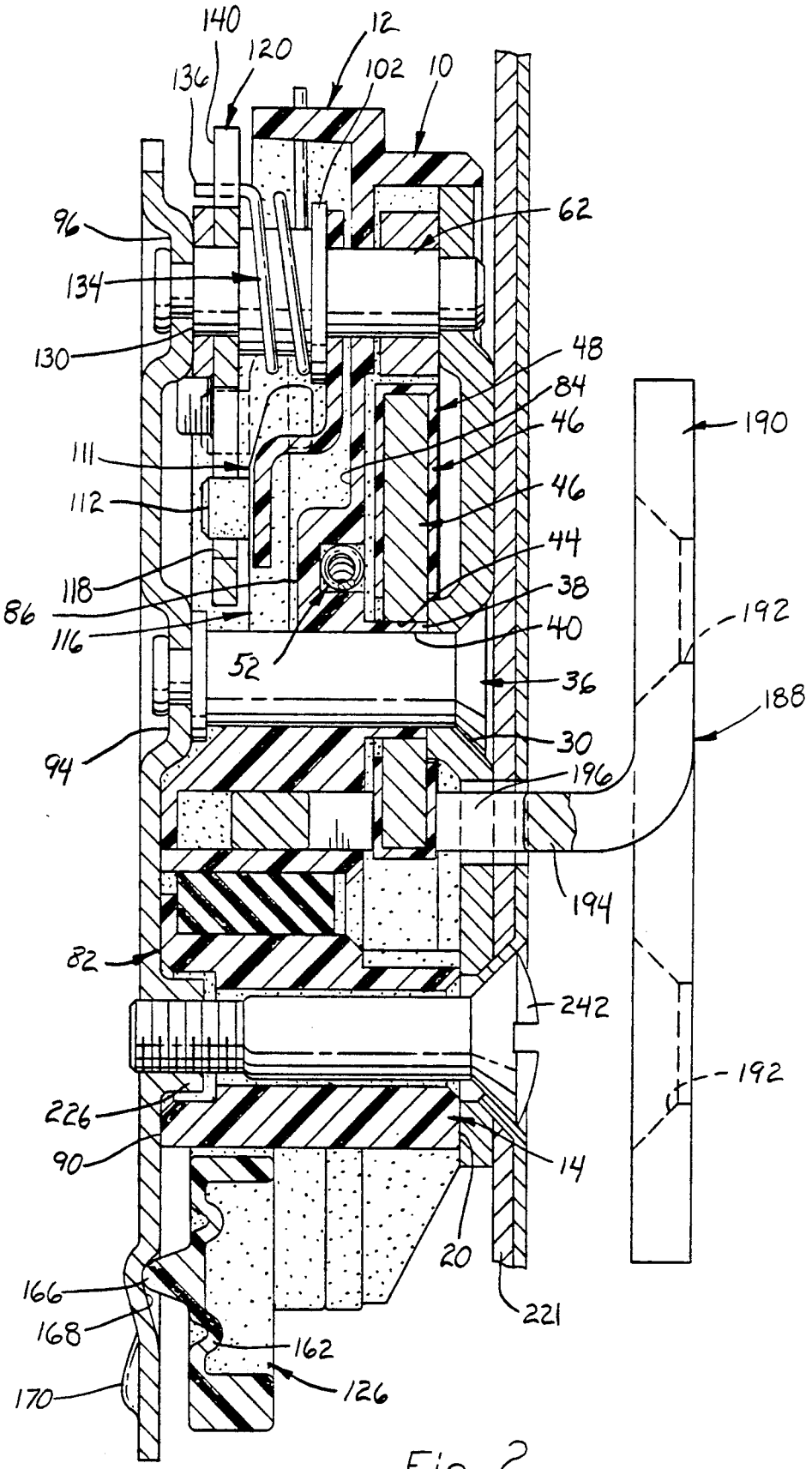
FIG. 2 is a sectional view taken substantially along line 2—2 of FIG. 1. An intermittent lever is also shown in phantom in a locked position.
Figure 6:
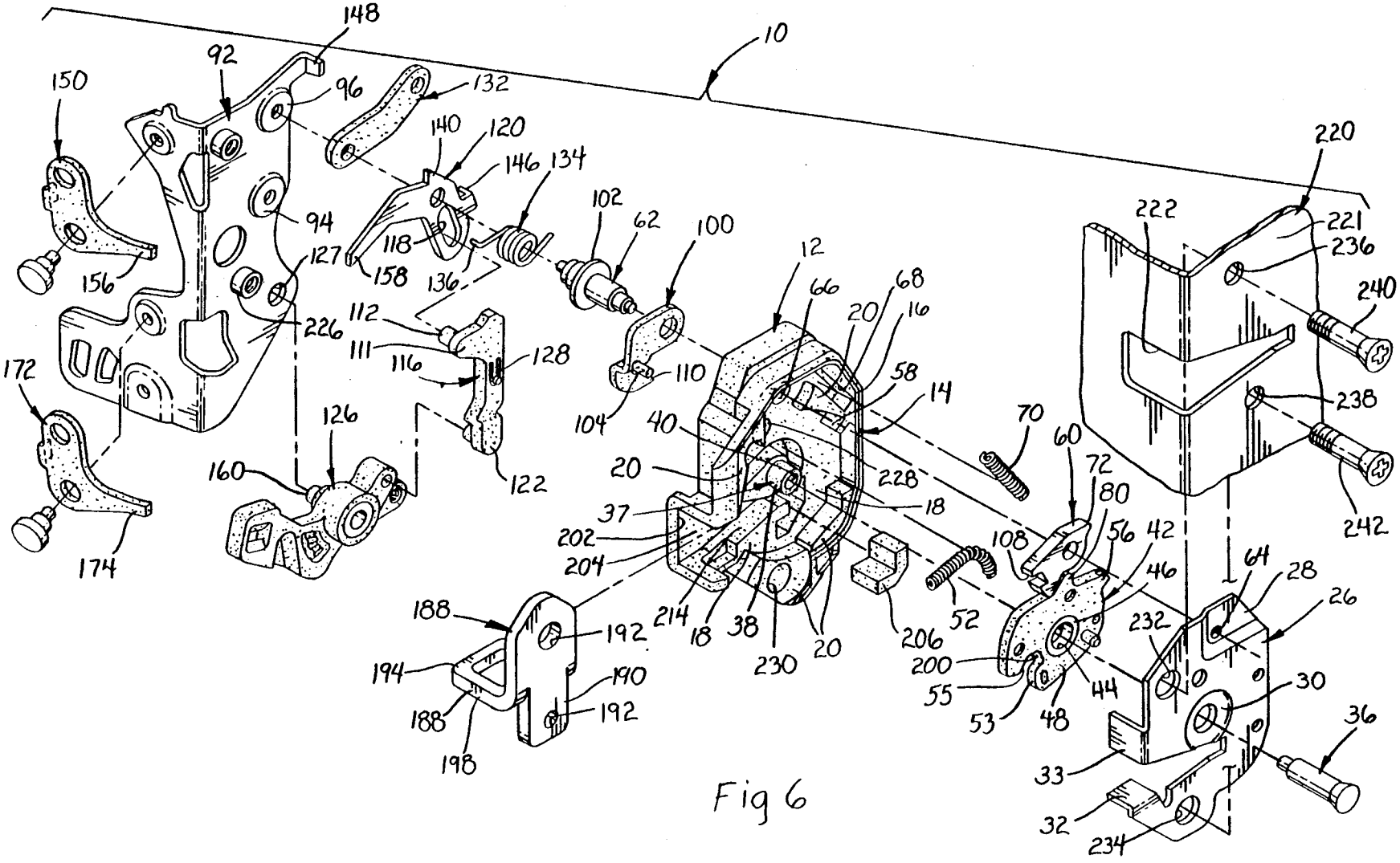
FIG. 6 is an exploded perspective view of the vehicle closure latch and a fragment of the door on which it is installed.

Referring to FIGS. 1, 2 and 6, a vehicle closure latch 10 includes a one-piece molded plastic housing member 12 which opens to a front side 14. The housing 12 includes relatively thin, broken peripheral wall 16, that outlines a cavity that has a recessed base wall 18. The housing 12 also has a number of coplanar shelf portions 20 inside the peripheral wall 16 that are only slightly recessed. A metal cover plate or frame member 26 fits within the wall portions 16, and seats on the shelf portions 20 to close the front side 14 of the housing 12. The frame 26 includes an inwardly recessed upper corner portion 28, an extruded central portion 30 and a pair of side tabs 32 and 33 as shown in FIG. 6.

A ratchet stud 36 is received by the extruded central portion 30 of the frame 26 which provides an increased support surface for the head end of the stud 36. A portion of the stud 36 is disposed in a thin plastic sleeve 37 that is integrally attached to the housing 12 and then in a hole 40 through the base wall 18 as shown in FIG. 2. The thin plastic sleeve facilitates assembly and then breaks away in service to provide a sleeve bearing 38 between the stud 36 and a rotatable closure latch ratchet 42.

Figure 7:
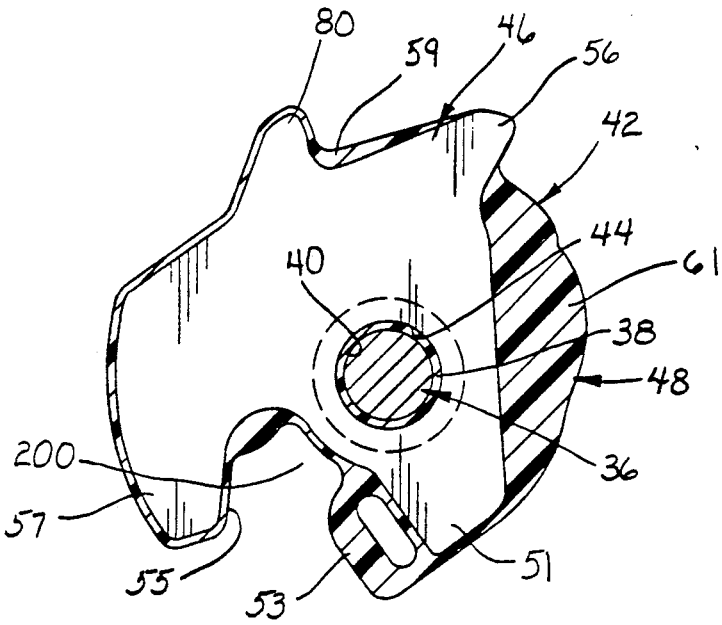
FIG. 7 is an enlarged front view of the insert molded closure latch ratchet.

Referring now to FIGS. 1, 6 and 7, the ratchet 42 comprises a metal substrate 46 that has a hole 44 that receives the stud 36 and the sleeve bearing 38 so that the ratchet 42 rotates on the stud 36 without any metal-to-metal contact. The integral plastic sleeve 37 then has two primary functions, that of locating the ratchet 42 during assembly, and that of providing a sleeve bearing 38 that eliminates metal-to-metal contact between the ratchet 42 and the stud 36 when the ratchet 42 rotates in service.

The metal substrate 46 which is best shown in hidden line in FIG. 7, is injection molded in a covering 48 of relatively tough and stiff thermoplastic material such as Santoprene, a product of Monsanto Company of St. Louis, Mo. The plastic covering 48 does not cover the hole 44 or the faces of the substrate 46 near the hole 44 of the ratchet 42, as best seen in FIGS. 5, 6 and 7 to avoid interfering with rotation of the ratchet 42.

Figure 5:
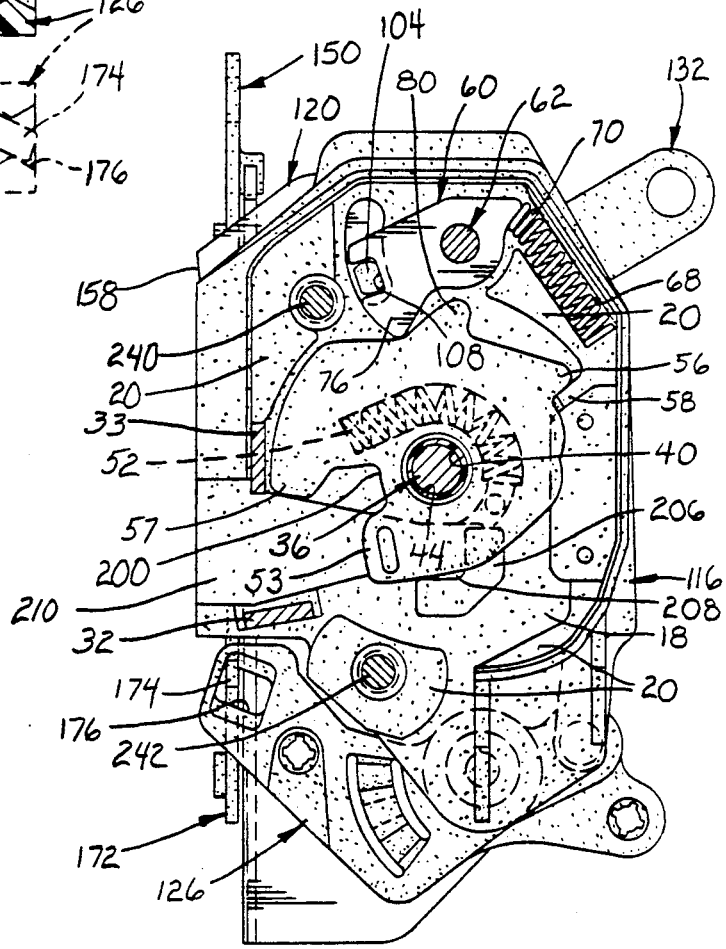
FIG. 5 is a view similar to FIG. 1 showing the vehicle closure latch in an unlatched and unlocked condition.

The plastic covering 48 also does not cover the peripheral surface of a primary latching tooth 56 so that there is metal-to-metal contact between the primary latching tooth 56 and the pawl 60 when the ratchet 42 is in the latched position as shown in FIGS. 1 and 5. The plastic covering 48, however does has a substantial presence in other peripheral areas. The covering 48 includes a thick portion in front of a striker tooth 51 that is slotted to provide an integral bumper 53 for cushioning initial engagement of a striker when the vehicle door is closed as explained below. The plastic covering 48 also includes another cushion 55 covering a keeper portion 57 of the ratchet 42 that engages the striker when the ratchet is in the latched position as shown in FIGS. 1 and 5. The plastic covering 48 also includes yet another cushion 59 that covers the periphery of the substrate 46 between the keeper portion 57 and the peak of the primary latching tooth 56 for quiet operation as the pawl 60 ratchets over a secondary latching tooth 80 when the door is closed. The plastic covering 48 further includes a large chord shaped area 61 between the primary latching tooth 56 and the striker tooth 51 that reduces the size and weight of the metal substrate 46 and also provides a base for an integral pin 43.

Referring now to FIG. 2, a groove 50 in the recessed base wall 18 houses a coil compression spring 52. The pin 53, as seen in hidden line in FIG. 1, molded integral with the sound deadening plastic covering 48 of the ratchet 42, engages one end of the coil compression spring 52. The other end of the spring 52 engages an end wall of the groove 50, so that the spring 52 biases the ratchet 42 clockwise from a latched position shown in solid line in FIG. 1 through an intermediate latched position (not shown) to an unlatched position shown in phantom in FIG. 1 and in solid line in FIG. 5 when pawl 60 is disengaged. The primary latching tooth 56 engages a shoulder 58 of the housing 12 to stop the ratchet 42 in the unlatched position.

Referring now to FIGS. 2 and 6, a pawl 60 is pivotally mounted on a pawl stud 62 for movement between an engaged position shown in solid line in FIG. 5 and an unlatching position shown in phantom in FIG. 5. A groove 68 in one of shelf portions 20 of the housing 12 houses a second coil compression spring 70. A shoulder 72 of the pawl 60 engages one end of the coil compression spring 70. The other end of the spring 70 engages an end wall of the groove 68 biasing the pawl 60 counterclockwise, as viewed in FIGS. 1 and 5, toward the engaged position. The pawl 60 has a pawl tooth 76 which engages the primary latching tooth 56 of the ratchet 42 as shown in FIG. 1 to latch the ratchet 42 in the fully latched position. Although not shown in the drawings, the pawl tooth 76 is also engageable with the secondary latching tooth 80 of the ratchet 42 to locate the ratchet 42 in an intermediate latched position where the ratchet 42 retains the striker 188 loosely.

Figure 3:
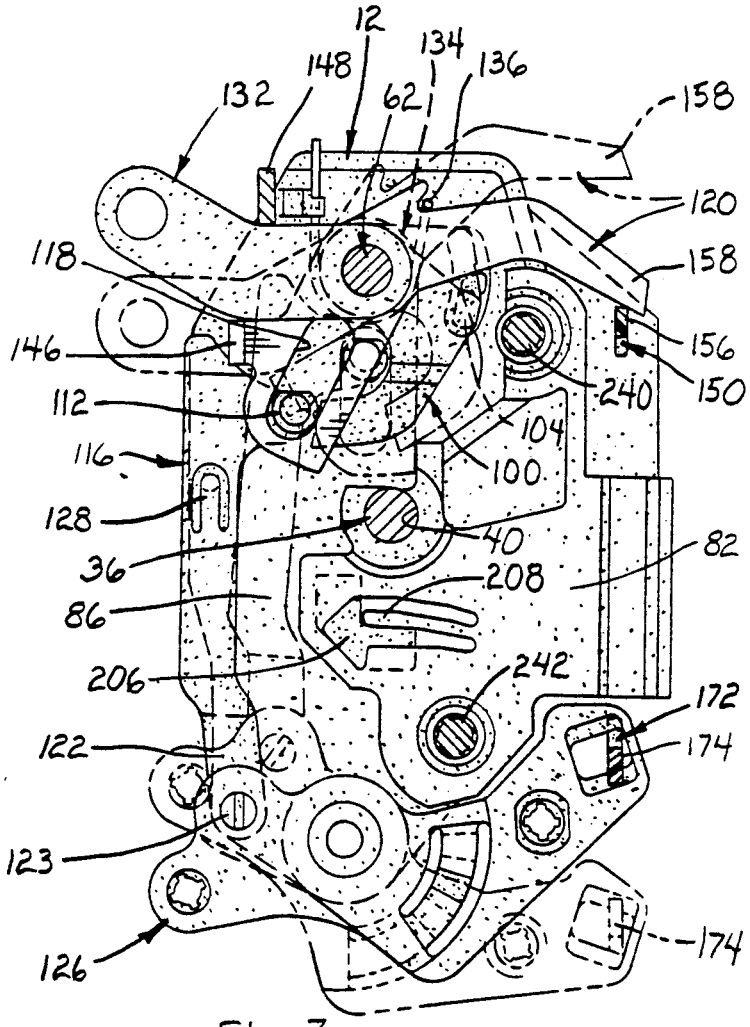
FIG. 3 is a rear view taken substantially along line 3—3 of FIG. 2. The latched and unlocked condition is shown in solid lines while various parts are also shown in phantom in unlatching or locked positions.

Referring to FIGS. 2 and 3, the housing 12 has a back side 82 with a series of rear base wall portions 84, 86, and 90, which are parallel. A metal back plate 92 engages the outer rear base wall portion 90 and includes a plurality of recessed portions 94 and 96 as shown in FIG. 6.

Referring to FIGS. 2 and 6, a non-metallic or plastic pawl release lever 100 is coaxially pivoted with the pawl lever 60 on the pawl stud 62 and between the rear base wall portion 84 and a rib 102 of the pawl stud 62. Referring to FIG. 1, the pawl release lever 100 has a lateral tab 104 which extends through a slot 106 in the housing 12 and is received by a notch 108 of the pawl 60 to couple the pawl release lever 100 to the pawl 60. Referring to FIGS. 3 and 6, an offset foot 110 of the pawl release lever 100 is engageable by an integral ear 111 of a non-metallic or plastic molded intermittent lever 116.

Referring to FIGS. 2 and 3, the integral ear 111 of the intermittent lever 116 has a pin 112 that is slideably captured in a linear tracking slot 118 of an unlatching lever 120. A lower end 122 of the intermittent lever 116 is pivotably mounted to a first end 124 of a locking lever 126 by a bifurcated protrusion 123 of the intermittent lever 116 that is biasingly engaged in a hole in the locking lever 126 to provide for quiet anti-rattle rotation. As shown in FIGS. 3 and 6, the intermittent lever 116 is interposed between the locking lever 126 and unlatching lever 120 on one side, and the rear base wall portion 86 of the housing 12 on the other. An integrally molded finger 128 of the intermittent lever 116 engages the rear base wall portion 86 to snugly bias the intermittent lever 116 against the locking lever 126 and the unlatching lever 120 to prevent rattling. The intermittent lever 116 moves with the locking lever 126 between an unlocked position shown in solid line in FIGS. 2 and 3 and a locked position shown in phantom.

The rotation of the pawl release lever 100 is dependent on the position of the intermittent lever 116, which is part of the locking mechanism, and the rotation of the unlatching lever 120, which is part of the unlatching mechanism. The unlatching mechanism will be discussed more fully before the discussion of the locking mechanism.

Referring to FIGS. 2 and 6, the unlatching lever 120, whose slot 118 receives the integral pin 112 of the intermittent lever 116, is pivotably mounted on the pawl stud 62 between a shoulder 130 of the pawl stud 62 and a non-metallic plastic molded outside operating lever 132. A coil torsion spring 134 encircles the panel stud 62 between the rib 102 and the shoulder 130, and it has a leg 136 which engages an upper edge 140 of the unlatching lever 120, as seen in FIG. 3. The other end of the coil torsion spring 134 engages a ramp on the housing 12 so that the torsion spring 134 biases the unlatching lever 120 clockwise to a rest position seen in FIG. 3. It should be noted that FIGS. 1, 5 and 6 are front views while FIG. 3 is a rear view. Consequently spring 134 biases unlatching lever 120 counter-clockwise in FIGS. 1, 5 and 6.

Referring to FIGS. 3 and 6, the outside operating lever 132, pivotably mounted on the pawl stud 62 and interposed between the back plate member 92 and the unlatching lever 120, seats on a lateral tab 146 of the unlatching lever 120. Referring to FIG. 3, an outside door handle (not shown) rotates the outside operating lever 132 counterclockwise to unlatch the closure latch 10. The outside operating lever 132 rotates the unlatching lever 120 counterclockwise simultaneously from their rest positions to their respective unlatching position, shown in phantom in FIG. 3. When released the outside operating lever 132 is returned to its rest position by the lateral tab 146 of the unlatching lever 120 transferring the bias of the torsion spring 134. A lateral tab 148, best seen in FIGS. 3 and 6, of the back plate 92 limits the clockwise motion of the outside operating lever 132 and the unlatching lever 120.

Figure 4:
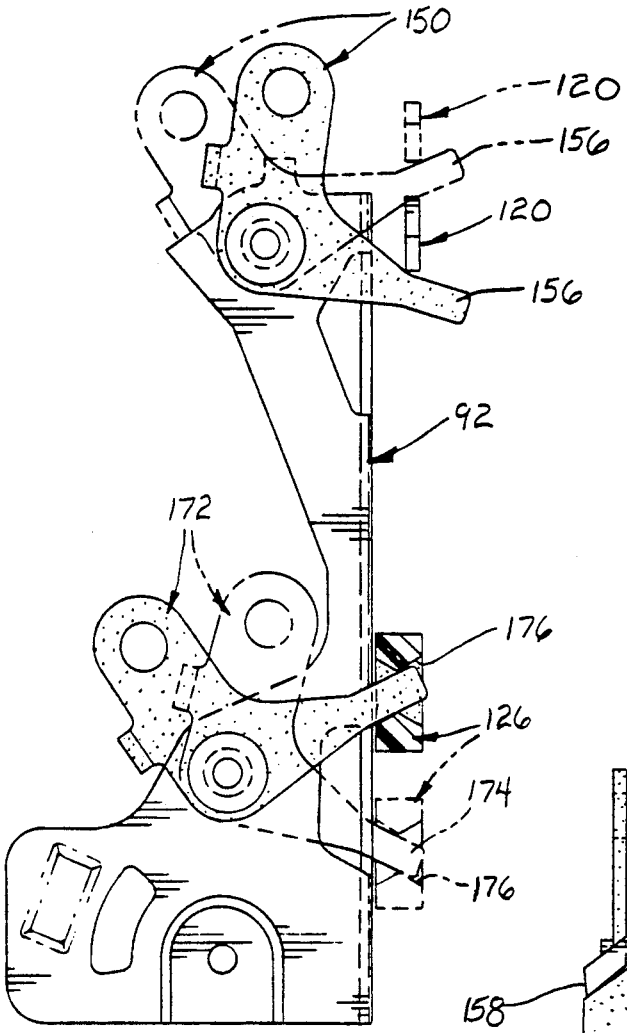
FIG. 4 is a partial sectional view taken substantially along line 4—4 of FIG. 1 with various parts also shown in phantom in unlatching or locked positions.

Referring to FIGS. 3, 4 and 6, a non-metallic plastic molded inside operating lever 150 is also capable of rotating the unlatching lever 120 to an unlatching position against the bias of torsion spring 134. The inside operating lever 150 is pivoted at 152 to a side flange 154 of the back plate 92 and it has a leg 156 underlying a leg 158 of the unlatching lever 120. The inside operating lever 150 is connected to and rotated by an inside operating handle, not shown. When lever 150 is rotated clockwise as viewed in FIGS. 4 and 6, it rotates the unlatching lever 120 counter clockwise is viewed in FIG. 3 (clockwise as viewed in FIG. 6).

Now that the operating levers of the unlocking mechanism have been described fully, the description of the locking mechanism will be completed. Referring to FIGS. 1 and 2, the locking lever 126 is pivotably mounted at 160 between a portion of the housing 12 and the back plate 92 by an integral protrusion of the housing 12 that fits in a pivot hole in the locking lever 126 and a stud of the locking lever 126 that fits in a pivot hole 127 in the back plate 92. The locking lever 126 includes an integral deflectable web 162 having a shoulder 166 biased into engagement with either a first recess 168 or a second recess 170 of the back plate 92 is shown in FIG. 2 to locate the locking lever 126 in either the unlocked position shown in solid line in FIG. 1 or in the locked position shown in phantom. The deflectable web 162 also provides tactile feel of the locking mechanism establishing positive position of the locking lever 126 in either the locked or unlocked position. The web 162 is made deflectable by spaced U-shaped portions connecting the shoulder 166 to the main part of the locking lever 126, as shown in FIG. 2.

The first end 124 of the locking lever 126 has an opening which is connected to an outside key cylinder by rod, or other suitable means, to move the locking lever 126 between the locked and unlocked positions.

Referring to FIGS. 1 and 4, a non-metallic, plastic molded inside locking lever 172 is pivotably mounted to the side flange 154 of the back plate member 92 at pivot point 173. The inside locking lever 172 is conventionally connected to an inside lock operator such as a linearly shiftable slide button. The inside locking lever 172 includes a leg 174 which is received within a tapered opening 176 at a second end 178 of the locking lever 126 such that movement of the inside locking lever 172 moves the locking lever 126 between its corresponding locked and unlocked positions. The inside locking lever 172 is identical to the inside operating lever 132 to reduce manufacturing cost.

With the unlatching mechanism and the locking mechanism described, the interaction between the two will be described. Referring to FIGS. 2 and 3, when the locking lever 126 and the intermittent lever 116 are in the unlocked position, thereby the integral pin 112 of the intermittent lever 116 is at a lower end 180 of the linear tracking slot 118 in the unlatching lever 120 in alignment for engagement with the foot 110 of the panel lever 100. Consequently, when the unlatching lever 120 is rotated counterclockwise by either the outside operating lever 132 or the inside operating lever 150 from the rest position to the unlatching position shown in phantom in FIG. 3, the integral pin 112 of the intermittent lever 116 engages the foot 110 of the panel release lever 100 rotating the panel release lever 100 and simultaneously rotate the panel 60 to the unlatching position shown in phantom in FIG. 1. This disengages the panel tooth 76 from the primary latching tooth 56 of the ratchet 42 which is then rotated clockwise by the spring 52 and/or the striker during door opening to the unlatched position shown in FIG. 5. Spring 70 returns the pawl 60 to the latched position when the unlatching lever 120 is released. During this unlatching movement, the intermittent lever 116 rotates about the bifurcated protrusion 123 which pivotally connects the lower end 122 to the locking lever 126.

When the locking lever and the intermittent lever 116 are in the locked position as shown in phantom in FIGS. 1 and 2 the integral pin 112 of the intermittent lever 116 is at an upper end 182 of the linear tracking slot 118 in the unlatching lever 120. Consequently when the unlatching lever 120 is rotated counterclockwise by either the outside operating lever 132 or the inside operating lever 150, the integral ear 111 of the intermittent lever 116 misses the foot 110 moving into a slot 184 of the pawl release lever 100 so that pawl release lever 100 and the pawl lever 60 are not rotated to the unlatching position and the pawl tooth 76 remains engaged with the primary latching tooth 56 of ratchet 42.

With the operating levers or unlatching mechanism and locking mechanism and their interaction described, the interaction of the door latch 10 with a striker 188 will be described. Referring to FIGS. 2 and 6, the striker 188 is formed out of a one-piece stamping which includes a mounting plate portion 190 having a pair of holes 192 for mounting to a vehicle body structure such as a vehicle pillar. Referring to FIG. 1, a loop striker portion 194 of rectangular cross section of the striker 188 includes an outboard leg 198 and an inboard leg 196. The outboard leg 198 is received in a throat 200 of the ratchet 42 of the door latch 10 when the door latch 10 is in the latched position.

Referring to FIGS. 1 and 6, the housing 12 of the door latch 10 has a deep recess 202 that extends inwardly from the base wall 18 to a back wall 204. The inner end of the recess 202 hooks back to form a spring arm 208 in cooperation with a slot through the back wall 204 as best shown in FIG. 3. A symmetrical elastomer bumper 206 is laterally inserted into the inner end of the recess 202 with the lower portion of the symmetrical elastomer bumper 206 being snapped past and held in place by the spring arm 208. The recess 202 defines a throat 210 within the plastic housing 12 to receive the striker 188. The frame 26 includes a "fishmouth" slot 212 that aligns with the throat 210 of the housing 12 when the frame 26 is attached. The side tabs 32 and 33 of the frame 26 project into slots of the housing 12 that communicate with the throat 210 as shown in FIGS. 1, 5 and 6. These tabs retain the ratchet 42 inside the plastic housing 12 in the event that the ratchet stud 36 and the plastic housing 12 itself do not do so.

Referring to FIG. 2, the door latch 10 is held together as an assembled door latch by the ratchet stud 36 and the pawl stud 62 which have their ends peened at the recessed portions 94 and 96 of the back plate 92 respectively. The ratchet stud 36 holds the plastic housing 12 metal frame 26 and back plate 92 together and also pivotally retains the ratchet 42 between the base wall 18 of the housing 12 and the metal frame 26. The pawl stud 62 peened at both ends helps align members 26, 12, and 92 and pivotally locates the pawl 60, the pawl release lever 100, the unlatching lever 120, and the outside operating lever 132 and carries the coil torsion spring 134. As stated above, the locking lever 126 is pivotably mounted at 160 and disposed between the housing 12 and the back plate 92. The inside operating lever 150 and the inside locking lever 172 are pivotally mounted on the side flange 154 of the back plate 92.

Referring to FIGS. 2 and 6, the assembled closure latch 10 is installed in a vehicle door 220 with the frame 26 abutting an interior surface of a free end wall 221 of a swinging door 220. The recessed corner portion 28 and the extruded central portion 30 of the metal frame 26 accommodate the head of the ratchet 30 and the peened head of the pawl 62 respectively. The end wall 221 and inner panel 223 of the door 220 have communicating slots that define an opening 222 that aligns with the throat 210 of the plastic housing 12 and the fishmouth slot 212 of the frame 26.

The closure latch 10 is attached to the door 220 by a pair of bolts 240 and 242 that are inserted into openings 236 and 238 in the end wall 221 through holes 232 and 234 in the frame 26 and holes 228 and 230 in the housing 12 and then screwed into threaded apertures 224 and 226 in the back plate 92. The bolts 240 and 242 also provide additional fasteners that hold the parts of the closure latch 10 together when the closure latch 10 is installed snug against the end wall 221.

Bolt 240 extends through the closure latch 10 in proximity to where the pawl tooth 76 of the pawl 60 engages one of the teeth 56 and 80 of ratchet 42 and sandwiches the engaged teeth between the housing 12 and the frame 26 so that the engaged teeth remain coplanar and do not bypass each other. In addition, the bolt 240, the ratchet stud 36 and the pawl stud 62 define an imaginary triangle that contains the engaged teeth of the ratchet 42 and pawl 60 between the housing 21 and the frame 36 providing further assurance that the engaged teeth do not bypass each other.

Bolt 242 extends through the door latch 10 in proximity to where the ratchet 42 engages the striker 188 when the ratchet 42 is in the latched position shown in FIG. 1. The ratchet stud 36 is about the same distance away on the opposite side of the throat 210 and the latched striker leg 196. The bolt 242 and the ratchet stud 36 both retain the closure latch 10 together and sandwich the ratchet 42 between the housing 12 and the frame 26 so that the ratchet 42 is held against lateral movement on both sides of the throat 210 near the engaged leg 196 of the striker 188. Consequently there is a very strong latching engagement of the striker 188.

The side tab 32 of the frame 26 protects the plastic housing 12 if the striker 188 is misaligned relative to the closure latch 10 and initially engages the throat 210 lower than desired. Moreover, as indicated earlier the side tabs 32 and 33 which are on opposite sites of the throat 210 are also positioned inboard of the ratchet 42 so that it cannot be pulled out of the plastic housing by the striker 188 as shown in FIG. 1 thereby enhancing the overall strength of the closure latch 10 under failure producing loads. It should also be noted the throat 210 of the plastic housing 12 and the fishmouth slot 212 of the cover plate 26 are relatively narrow when the vehicle closure latch 10 is designed for use with the striker 188 which is characterized by a loop portion of rectangular cross section. This relatively narrow fishmouth slot further enhances the overall strength of the door latch 10 because the minimum thickness of the metal plate 26 between the hole in the central portion 30 and the fishmouth slot 212 is increased in comparison to designs that are used with striker loop portions of circular cross section and that have the same operating effort.

The striker is the subject of a pending patent application, Ser. No. 971,159 filed Nov. 5, 1992 and assigned to the assignee of this invention.

OPERATION

Referring to FIGS. 1 and 5, as the door 220 is being closed, the outboard leg 196 of the striker 188 enters the throat 210 and engages the bumper 53 of the ratchet 42 and rotates the ratchet 42 counterclockwise from its unlatched position shown in FIG. 5, to its latched position shown in FIG. 1. The striker 188 is stopped in the latched position by the elastomer bumper 206. During this latching movement, the pawl tooth 76 first ratchets over the secondary latching tooth 80 and then the primary latching tooth 56 of the ratchet 42 until it engages the back side of the primary latching tooth 56 under the bias of compression spring 70.

This operation is quiet due to the sound deadening covering 48 of the ratchet 42 which is best shown in FIG. 7. First the striker engages the slotted bumper 53 which isolates the metal substrate 46 and deflects because of the slot to absorb the energy and sound of the striker 188 engaging the ratchet 42. Secondly the peripheral portion 59 of the covering 48 absorbs most of the energy and sound of the pawl 60 as the pawl tooth 76 ratchets on the ratchet 42 into position behind the primary latching tooth 56. Thirdly the latched leg 196 is stopped by the elastomer bumper 206 and held by the cushion 55 of the keeper portion 57 of the ratchet 42. This absorbs the energy and sound of the striker when the door is closed.

Referring to FIG. 2, the initial engagement and rotation of the ratchet 42 by the striker 188 creates a load on the thin plastic sleeve 37 that is generally uniform across the thickness of the ratchet 42. The thin plastic sleeve 37 that is integrally attached to the base wall 18 of the housing 12 in service without a radius which creates a stress riser at the corner of the sleeve and the base wall. The combination of the striker load and the stress riser causes the corner to fracture so that the thin plastic sleeve 37 breaks away from the base wall 18 of the housing 12 in service to provide a plastic sleeve bearing 38 between the metal ratchet stud 36 and the metal bore of the ratchet 42 that functions as a silencer.

Unlatching the closure latch 10 to open the door is accomplished by releasing the striker 188 from the throat 200 of the ratchet 42 by disengaging the pawl tooth 76 from the primary latching tooth 56 so that the coil compression spring 52 returns the ratchet 42 to the unlatched position as described earlier. The door seal force also assists in latch disengagement of the striker 188.

The extensive use of non-metallic or plastic parts, except for the ratchet 42, the pawl 60 and the associated studs and springs which are required to hold the closure latch 10 in the latched position, the plastic covering of the ratchet 42 and the break-away sleeve bearing 38 reduces the metal-on-metal contact to a minimum thereby creating a closure latch that is very quiet in operation and that requires little if any lubrication. Furthermore, the integral finger 128 of the intermittent lever 116 and the internal web 162 of the locking lever 126 reduce vibration of these parts and the associated noise to enhance quiet operation.

The latch shown in the Figures is a right-hand closure latch used on the passenger side of a vehicle. A left-hand closure latch for the driver side of the vehicle work the same, but the latches are mirrored images of each other. Consequently, some parts of the latch are designed so that they can be used for either a right-hand or left-hand closure latch to reduce manufacturing cost. For example, the pawl 60 and outside operating lever 132 are non-handed and can be used on either a right-hand or a left-hand closure latch by flipping the part over. The metal substrate of the ratchet 42 is also non-handed and capable of being used in either latch, prior to being insert molded, where the pin 53 is added to one side of the cover. The right angled elastomer bumper 206 is symmetrical about multiple planes so that the bumper 206 can be used one-way for a right hand latch or rotated 90° for a left hand latch. In addition, the inside operating lever 150 and inside locking lever 172 are also identical to further reduce manufacturing costs.

The invention has been described in an illustrative manner, and it is to be understood that the terminology which has been used is intended to be in the nature of words of description rather than of limitation.

Obviously, many modifications and variations of the present invention in light of the above teachings may be made. it is, therefore, to be understood that, within the scope of the appended claims, the invention may be practiced otherwise than as specifically described.

The embodiments of the invention in which an exclusive property or privilege is claimed are defined as follows:

1. A vehicle closure latch for mounting on a vehicle closure so as to engage and retain a striker mounted on a vehicle body when the vehicle closure is closed, the vehicle closure latch comprising:

a housing having a cover plate and a back plate;

a ratchet pivotably mounted in the housing behind the cover plate for movement between a latched position and an unlatched position; the ratchet having a latching tooth and a throat for receiving a striker;

a pawl pivotably mounted in the housing behind the cover plate for movement between an engaged position and a releasing position, the pawl having a pawl tooth that engages the latching tooth of the ratchet to hold the ratchet in the latched position; and means for securing the vehicle closure latch to a vehicle closure consisting of first and second series of aligned bolt holes extending through the cover plate, the housing and the back plate.

2. The vehicle closure latch as defined in claim 1 wherein the first series of bolt holes is located in proximity to the engaged teeth of the ratchet and pawl and the second series of bolt holes is located in proximity to the throat of the ratchet.

3. The vehicle closure latch as defined in claim 1 wherein the holes of the back plate are threaded.

4. The vehicle door latch as defined in claim 1 wherein the vehicle closure latch has ratchet and pawl studs that fasten the housing, cover plate and back plate together as an assembled door latch for installation in a vehicle.

5. The vehicle closure latch as defined in claim 4 wherein the first series of bolt holes and the ratchet stud are approximate opposite sides of the engaged teeth of the ratchet and pawl.

6. The vehicle closure latch as defined in claim 4 wherein the first series of bolt holes, the ratchet stud and the pawl stud form an imaginary triangle that contains the engaged teeth of the ratchet and pawl.

7. The vehicle closure latch as defined in claim 4 wherein the ratchet stud and the second series of holes are approximate opposite sides of the throat of the ratchet when it is in the latched position.

8. A vehicle closure latch for mounting on a vehicle closure so as to engage and retain a striker mounted on a vehicle body when the vehicle closure is closed, the vehicle closure latch comprising:

a housing having a cover plate and a back plate;

a ratchet pivotably mounted in the housing behind the cover plate for movement between a latched position and an unlatched position; the ratchet having a latching tooth and a throat for receiving a striker;

a pawl pivotably mounted in the housing behind the cover plate for movement between an engaged position and a releasing position, the pawl having a pawl tooth that engages the latching tooth of the ratchet to hold the ratchet in the latched position;

means for securing the vehicle closure latch to a vehicle closure consisting of first and second series of aligned bolt holes extending through the cover plate, the housing and the back plate; and the housing having a throat for receiving a striker and the cover plate having tabs that are located on opposite sides of the throat for retaining the ratchet in the housing.

9. A vehicle closure latch for mounting on a vehicle closure so as to engage and retain a striker mounted on a vehicle body when the vehicle closure is closed, the vehicle closure latch comprising:

a plastic housing having a metal cover plate, and a metal back plate;

a ratchet pivotably mounted in the plastic housing behind the cover plate for movement between a latched position and an unlatched position by a ratchet stud that fastens the plastic housing, the metal cover plate and the metal back plate together, the ratchet having a latching tooth and having a throat for receiving the striker;

a pawl pivotably mounted in the plastic housing behind the cover plate member for movement between an engaged position and a releasing position by a pawl stud that fastens the plastic housing, the metal cover plate and the metal back plate together, the pawl having a pawl tooth that engages the latching tooth of the ratchet to hold the ratchet in the latched position;

means for securing the vehicle closure latch to a vehicle door comprising first and second series of aligned bolt holes extending through the metal cover plate, the plastic housing and the metal back plate, the first series of bolt holes and the ratchet stud being approximate the opposite sides of the engaged teeth of the ratchet and pawl, the first series of bolt holes, the ratchet stud and the pawl stud forming an imaginary triangle that contains the engaged teeth of the ratchet, and the ratchet stud and the second series of holes being approximate opposite sides of the throat of the ratchet when it is in a full latch or an intermediate latch position.

10. The vehicle closure latch as defined in claim 9 wherein the holes of the back plate are threaded.

11. The vehicle closure latch as defined in claim 9 wherein the means for securing the vehicle door latch to a vehicle door constitutes the sole means for securing the vehicle door latch to the vehicle closure.

12. A vehicle closure latch for mounting on a vehicle closure so as to engage and retain a striker mounted on a vehicle body when the vehicle closure is closed, the vehicle closure latch comprising:

a plastic housing having a metal cover plate, and a metal back plate;

a ratchet pivotably mounted in the plastic housing behind the cover plate for movement between a latched position and an unlatched position by a ratchet stud that fastens the plastic housing, the metal cover plate and the metal back plate together, the ratchet having a latching tooth and having a throat for receiving the striker;

a pawl pivotably mounted in the plastic housing behind the cover plate for movement between an engaged position and a releasing position by a pawl stud that fastens the plastic housing, the metal cover plate and the metal back plate together, the pawl having a pawl tooth that engages the latching tooth of the ratchet to hold the ratchet in the latched position;

means for securing the vehicle closure latch to a vehicle door comprising first and second series of aligned bolt holes extending through the metal cover plate, the plastic housing and the metal back plate, the first series of bolt holes and the ratchet stud being approximate the opposite sides of the engaged teeth of the ratchet and pawl, the first series of bolt holes, the ratchet stud and the pawl stud forming an imaginary triangle that contains the engaged teeth of the ratchet, the ratchet stud and the second series of holes being approximate opposite sides of the throat of the ratchet when it is in a full latch or an intermediate latch position; and the housing having a throat for receiving a striker, the cover plate having a slot that is aligned with the throat of the housing, and the cover plate having perpendicular tabs that are located on opposite sides of the slot for retaining the ratchet in the housing.

13. The vehicle closure latch as defined in claim 9 wherein the housing has a relatively narrow throat and the cover plate has a relatively narrow aligned slot for receiving a loop striker portion of rectangular cross section.

14. A vehicle closure latch for mounting on a vehicle closure so as to engage and retain a striker mounted on a vehicle body when the vehicle closure is closed, the vehicle closure latch comprising:

a plastic housing that has a base wall that has a hole extending through it for receiving a ratchet stud for pivotally mounting a ratchet in the plastic housing, the plastic housing having an integral plastic sleeve that is attached to the base wall in alignment with the hole that extends through the base wall for rotatably mounting a ratchet in the housing temporarily, and the plastic sleeve being frangibly connected to the base wall so that it breaks away in service to provide a sleeve bearing between a ratchet stud that is assembled to the housing by insertion into the plastic sleeve and the hole of the base wall and a ratchet that is rotatably mounted on the plastic sleeve.

15. The vehicle closure latch as defined in claim 14 wherein the plastic sleeve is attached to the base wall of the plastic housing so as to create a stress riser at a corner of the plastic sleeve and the base wall of the plastic housing.

16. The vehicle closure latch as defined in claim 14 wherein the plastic sleeve is attached to the base wall of the plastic housing without a corner radius so as to create a stress riser at a square corner of the plastic sleeve and the base wall of the plastic housing.

17. A vehicle closure latch for mounting on a vehicle closure so as to engage and retain a striker mounted on a vehicle body when the vehicle closure is closed, the vehicle closure latch comprising:

a plastic housing having a metal cover plate and a metal back plate;

the plastic housing having a base wall that has a hole extending through it and an integral sleeve attached to the base wall in alignment with the hole, a ratchet pivotably mounted on the integral sleeve in the plastic housing behind the cover plate for movement between a latched position and an unlatched position;

a metal ratchet stud disposed in the hole and the sleeve for holding the plastic housing and the metal cover plate together and pivotally mounting the sleeve when it breaks away in service, a pawl pivotally mounted in the plastic housing behind the metal cover plate by a metal pawl stud that holds the plastic housing and the metal cover plate together, the pawl being pivotally moveable between an engaged position holding the ratchet in its latched position and an unlatching position releasing the ratchet from its latched position, a non-metallic pawl releasing lever that is pivotally mounted on the pawl stud behind the plastic housing for pivotal movement between a latched position and an unlatching position, the non-metallic pawl releasing lever having a tab that extends through a hole in the plastic housing and engages the pawl to pivot the pawl to its unlatching position when it is pivoted to its unlatching position, an unlatching lever that is pivotally mounted on the pawl stud behind the plastic housing for pivotal movement between a latched position and an unlatching position, a locking lever pivotally mounted behind the plastic housing for movement between a locked position and an unlocked position, and a non-metallic intermittent lever interconnecting the unlatching lever and the locking lever, the intermittent lever having a portion that engages and pivots the pawl releasing lever to its unlatching position when its unlatching lever is pivoted to its unlatching position and the locking lever is in the unlocked position, and that bypasses the pawl releasing lever when the locking lever is in its locked position so that the motion of the unlatching lever is not transferred to the pawl releasing lever when the locking lever is in its locked position.

18. The vehicle closure latch as defined in claim 17 further including a non-metallic or plastic outside operating lever that is pivotally mounted on the metal pawl stud behind the plastic housing for pivoting the unlatching lever to its unlatching position by a outside door handle.

19. The vehicle closure latch as defined in claim 17 further including a non-metallic or plastic inside operating lever that is pivotally mounted on the metal back plate for pivoting the unlatching lever to its unlatching position by an inside door handle.

20. The vehicle closure latch as defined in claim 17 further including a non-metallic or plastic inside locking lever that is pivotally mounted on the metal back plate for pivoting the locking lever between its locked and unlocked positions by an inside door operator.

21. The vehicle closure latch as defined in claim 19 further including a non-metallic or plastic inside locking lever that is pivotally mounted on the metal back plate for pivoting the locking lever between its locked and unlocked positions by an inside door operator and wherein the plastic inside operating lever and the plastic inside locking lever are identical in structure.

22. The vehicle closure latch as defined in claim 17 wherein the intermittent lever is plastic and has a bifurcated protrusion that is biasingly engaged in a hole of the locking lever for an anti-rattle interconnection and wherein the plastic intermittent lever has an integrally molded finger that engages the plastic housing to snugly bias the intermittent lever against the locking lever to prevent rattling.

23. The vehicle closure latch as defined in claim 17 wherein the locking lever is plastic and includes an integral deflectable web that has a shoulder, the shoulder being biased by the web into engagement with first and second recesses in the back plate to locate the locking lever in its locked and unlocked positions respectively.

24. The vehicle closure latch as defined in claim 17 wherein the ratchet comprises a metal substrate and a plastic covering, the metal having a primary latching tooth that has an exposed latching surface that is engaged by the pawl when the ratchet is held in the latched position.

25. The vehicle closure latch as defined in claim 24 wherein the pawl is a lubricant impregnated powder metal part.

26. The vehicle closure latch as defined in claim 24 wherein the substrate is non-handed so that it can be used in right hand and left hand door latches.

27. The vehicle closure latch as defined in claim 17 further including an elastomeric bumper that is mounted in the plastic housing for engaging a striker when the vehicle door is closed and the ratchet is moved to the latched position, the elastomeric bumper being symmetric about several planes so that the elastomeric bumper can be used in right hand and left hand door latches.

* * * * *